US005290164A

United States Patent [19]

Schiel

[11] Patent Number: 5,290,164

[45] Date of Patent: Mar. 1, 1994

[54] APPARATUS FOR THE MANUFACTURE OF A PRESS JACKET

[75] Inventor: Christian Schiel, Heidenheim, Fed. Rep. of Germany

[73] Assignee: J. M. Voith GmbH, Fed. Rep. of Germany

[21] Appl. No.: 889,678

[22] Filed: May 28, 1992

[30] Foreign Application Priority Data

May 29, 1991 [DE] Fed. Rep. of Germany ..... 4117561

[51] Int. Cl.[5] ..... B29C 65/00

[52] U.S. Cl. ..... 425/111; 156/446; 264/271.1; 425/115; 425/447

[58] Field of Search ..... 57/352, 357, 358, 359; 156/433, 441, 446, 447; 162/358.3, 358.4; 264/257, 258, 271.1; 425/111, 115, 224, 447, 471

[56] References Cited

U.S. PATENT DOCUMENTS

| | | | |
|---|---|---|---|
| Re. 33,034 | 8/1989 | Schiel et al. | 241/119 |
| 3,162,709 | 12/1964 | Davidson | 425/111 |
| 3,740,291 | 6/1973 | Mallard | 425/111 |
| 3,795,472 | 3/1974 | Gruss et al. | 425/111 |
| 3,901,963 | 8/1975 | Werner | 425/111 |
| 3,956,056 | 5/1976 | Boguslawski et al. | 425/111 |
| 4,051,216 | 9/1977 | Bratchell | 425/111 |
| 4,238,287 | 12/1980 | Gill | 162/358 |
| 4,552,620 | 11/1985 | Adams | 162/358 |
| 4,689,003 | 8/1987 | Schreiner et al. | 425/224 |
| 5,134,010 | 7/1992 | Schiel | 428/113 |

FOREIGN PATENT DOCUMENTS

| | | |
|---|---|---|
| 2106557 | 9/1982 | United Kingdom . |
| 8808897 | 11/1988 | World Int. Prop. O. . |

OTHER PUBLICATIONS

Voith, "Biegsames Band für eine zum Entwässern einer Faserstoffoahn dienende Presse", Jul. 26, 1984, mmel/59, pp. 1-9.

*Primary Examiner*—Charles S. Bushey

*Attorney, Agent, or Firm*—Ostrolenk, Faber, Gerb & Soffen

[57] ABSTRACT

Apparatus for manufacturing a press jacket from pourable elastomeric material with reinforcement threads. A cylindrical pouring body. A longitudinal thread tensioning device at the pouring body. A feed device for feeding circumferential threads to the pouring body. A pouring nozzle for pouring the elastomeric material to the pouring body. A spacing device maintains a constant distance between the longitudinal threads and the jacket surface of the pouring body as well as a constant circumferential distance between adjacent longitudinal threads. The spacing device includes a plurality of segments. Each segment has an L-shaped cross section. The radial arm has slots for the passage of longitudinal threads and furthermore teeth present between the slots. A slide is rigidly fastened to the support and includes rollers which engage the segments and move the spacing device along the pouring body.

13 Claims, 5 Drawing Sheets

APPARATUS FOR THE MANUFACTURE OF A PRESS JACKET

BACKGROUND OF THE INVENTION

The present invention relates to an apparatus for manufacturing a press jacket for use in the paper making industry. Apparatus and jackets of this type are known from Federal Republic of Germany 37 15 153 A1, which corresponds to U.S. Pat. No. 5,134,010, issuing Jul. 28, 1992.

The preferred field of use of such press jackets is in the press section of a paper manufacturing machine. In such a machine, the press having the press jacket may be a so called long nip press or extended nip press, such as ones known from U.S. Pat. No. 4,238,287 (FIG. 1)

U.S. Pat. No. 4,552,620 (FIG. 5)

Federal Republic of Germany OS 32 35 468 (FIG. 1), and

Voith publication "Multi-layer band" (publication reference P 4022 K/0197H/Sh/Srö in the Library of the German Patent Office received on Jul. 26, 1984). Any of these long nip presses may be used in combination with any suitable paper manufacturing machines.

However, in accordance with Federal Republic of Germany OS 35 01 635 (FIG. 6), which corresponds to U.S. Pat. No. Re. 33,034 this press apparatus can also be a press roll having a loosely arranged press jacket in a so-called mat calender. Furthermore, a pressing device can be developed in combination with a press jacket shrunk onto a roll.

Known press jackets are based on flat fabric like pre-products, which are made endless by connecting together the ends of the flat product. They then go through the following successive production steps:

pouring of elastomeric material onto one side of the fabric jacket which had been made endless;

smoothing the resultant surface;

turning the fabric jacket inside out;

pouring the elastomeric material onto the second now outward side of the fabric jacket;

smoothing the second surface and possibly introducing grooves and/or holes in the jacket.

An apparatus for performing the production steps includes a number of features. A pouring body has a series of circumferentially spaced apart, longitudinally extending threads supported above its surface. The pouring body is placed in slow rotation. At the same time, a support bearing for a pouring nozzle for elastomeric material is moved along the longitudinal axis of the pouring body and that bearing also moves the pouring nozzle in this direction along with a feed device for feeding circumferential reinforcing threads to the pouring body. As the pouring nozzle discharges elastomeric material in the direction toward the jacket surface of the pouring body and as the circumferential threads are also delivered by the feed device, the circumferential threads and the elastomeric material are applied along a helical path onto the jacket of the casting body. During this process, the circumferential threads are placed over the longitudinal threads which have already been tensioned. Together these two direction threads form a thread grid. The poured on elastomeric material penetrates through this thread grid and embeds it, and/or the circumferential threads penetrate into the still flowable elastomeric material until they contact the longitudinal threads, depending upon whether the circumferential threads are applied shortly before or after the elastomeric material.

A thread spacing device performs an important function. On the one hand, it maintains a constant distance between the longitudinal threads and the jacket surface of the pouring body. On the other hand, it maintains the distance apart of two adjacent longitudinal threads. This spacing device is developed as a ring which surrounds the pouring body and is displaceable in the axial direction along that body. The ring comprises a distance maintaining ring which rests on the surface of the pouring body and holds the longitudinal threads spaced from the jacket surface of the pouring body. Behind the thread spacing maintaining ring, as seen in the direction of displacement of the support, another ring is arranged. It is developed like a comb with teeth engaging through the space between two adjacent longitudinal threads. The teeth are of a width equal to the desired distance between two longitudinal threads.

The known spacing device has one serious problem. The circumferences of the press jackets have recently become larger. Therefore, the pouring body must be made correspondingly larger in diameter as must the ring shaped spacing devices. Such rings are more difficult to manufacture, are of greater weight, and are heavy and more difficult to handle. There is the danger that upon their displacement along the pouring body, the rings will cant during the manufacture of the press jacket.

SUMMARY OF THE INVENTION

The object of the present invention is to develop a press jacket forming apparatus such that the distance between the longitudinal threads and the jacket surface of the pouring body, as well as the distance between two adjacent longitudinal threads, are suitably maintained during manufacture of the press jacket, but so that the spacing device is easy to manufacture and easy to handle and the danger of the spacing device canting is avoided.

Rather than having the form of a rigid ring, the spacing device of the invention in one embodiment comprises a plurality of segments, each extending over part of the circumference of the pouring body. It is important that there is no longer a single rigid ring which is closed over its entire circumference but that there are instead separate ring sections or segments. The segments can be connected with each other in any way. It is merely necessary that their connection not be rigid. For instance, an articulated connection between adjacent sections is conceivable, thus producing a sort of ring chain. A plug type connection is also conceivable, particularly if it permits bending from segment to segment. It is also possible that adjacent segments not be connected to each other at all by a separate element. Instead, the ends of two adjacent segments may merely overlap each other.

The arm of the individual segment which is present on the jacket surface has slots with teeth present between them. The longitudinal threads lie within the slots and this engagement exerts a guide function, so that further connection between two adjacent segments is dispensed with.

An alternate embodiment avoids use of individual segments. Instead, there is a single endless loop band of flexible material which acts like a series of articulated segments.

During operation of the apparatus and thus during a revolution of the pouring body, the slide connected with the support is continuously in engagement with the segments. As the pouring body rotates, the stationary slide elements engage successive spacing device segments as they rotate past in sequence. An element of the stationary slide rests against the back of many or even of all segments and pushes the segments forward so that each segment is advanced axially, once per revolution of the pouring body, by an amount equal to the pitch of the elastomeric material spiral being applied. If a single flexible band is used instead of segments, the slide has elements which engage at intervals along the band.

In this connection, the slide can have a firm slide surface in engagement with each segment, but it can also be provided with rollers so that sliding friction between the slide stop surface and the backs of the segments is avoided.

Other features and advantages of the present invention will become apparent from the following description of the invention which refers to the accompanying drawings.

DETAILED DESCRIPTION OF THE INVENTION

Figure 1:
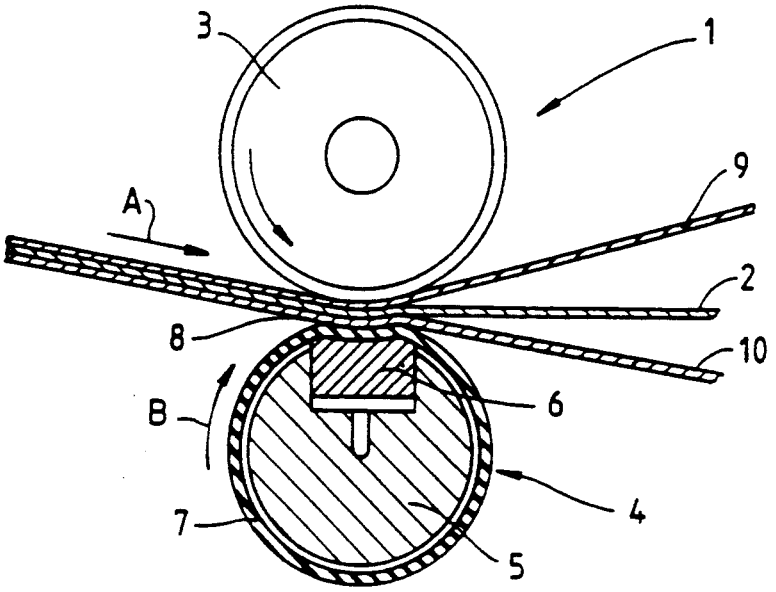
FIG. 1 shows a portion of a press for the draining of paper webs having a press jacket guided over a pressure shoe.

FIG. 1 shows a portion of a press 1, without the frame shown, the press being for draining water from a paper web 2 which is traveling through the press. The press 1 essentially comprises an upper roll 3 and a lower roll 4. The lower roll is not really a roll. It comprises a stationary core 5 having a pressure shoe 6 guided in the core to be pressed hydraulically against the upper roll 3. The stationary core 5 and the hydraulically supported pressure shoe 6 of the lower roll 4 are surrounded by an endless tubular flexible press jacket 7. The jacket is comprised of a flexible, nonelastic material with embedded reinforcement threads.

The press jacket 7 has a smooth inner surface that slides over the exposed outer surface of the pressure shoe 6. Together with the upper roll 3, these form a lengthened press zone 8, known as a long nip press or an extended nip press. The outer surface of the pressure shoe 6 is developed generally complementary in shape to the curvature of the upper roll 3, i.e. the pressure shoe 6 has a small cavity on its slide surface which has a diameter that generally corresponds to the diameter of the upper roll 3 with which it cooperates.

In order to prevent friction between the pressure shoe 6 and the press jacket 7, a known device (not shown) is used for wetting the inside of the press jacket with lubricant to ease its passage over the shoe.

The paper web 2 to be dewatered in the press is fed between two so called drainage felts or fabric belts 9, 10 to the press zone 8 in the direction of arrow A. Due to frictional rubbing by the drainage felt 10against the press jacket 7, which slides over the pressure shoe 6, the press jacket 7 is moved around the core 5 and over the pressure shoe 6 along the path of arrow B, thereby taking up water from that drainage felt 10. The surface of the press jacket 7 must be suitable to remove water from the press zone 8 between the pressure shoe 6 and the upper roll 3, particularly water which has been given off by the paper web 2 in the press zone 8 and which has passed through the drainage felt 10.

The press jacket 7 forms the subject of the present invention. FIG. 1 shows the use of the jacket in a press section for removing water from a paper web, and for this purpose the surface of the press jacket is developed to be able to receive water pressed out from the paper web 2. However, other uses of the press jacket 7 are also conceivable, for instance, as a mat calendar of a paper manufacturing machine. In that case, the outer surface of the press jacket must have a structure which is as smooth and even as possible.

Aside from uses in paper manufacturing machines, however, further fields of use for such a press jacket are also conceivable.

The press jacket 7 and its manufacture are described below.

Figure 2A:
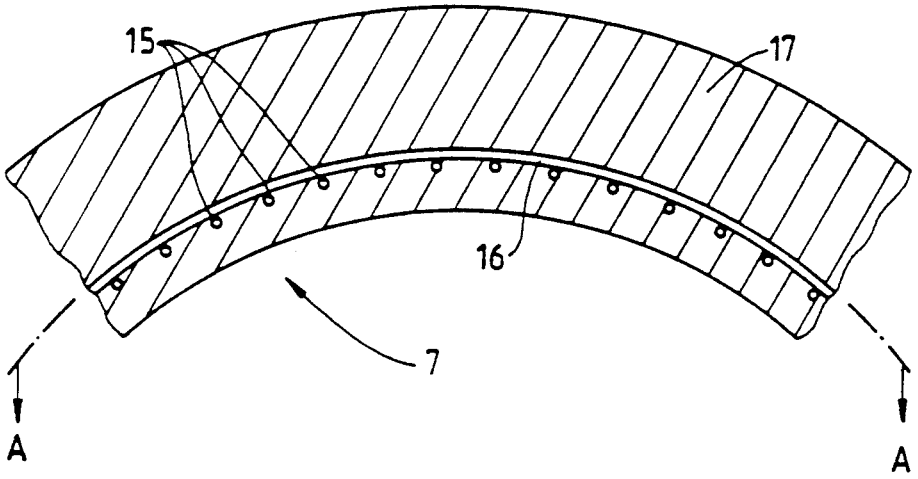
FIG. 2*a* shows a portion of the structure of the press jacket of the invention in elevational cross section.
Figure 2B:
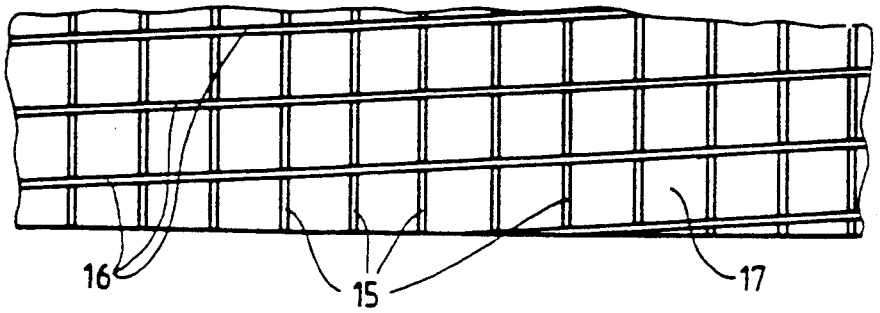
FIG. 2*b* shows the portion of the structure of FIG. 2*a* in cross section along the curve of and in the radially inward direction shown by arrows A—A in FIG. 2*a*.

FIGS. 2*a* and 2*b* show the structure of the press jacket 7 in elevational cross section in FIG. 2*a*, similar to FIG. 1, and in plan in FIG. 2*b* in a sectional view of a press jacket 7 taken at the level of the reinforcing threads. FIG. 2*a* shows a poured press jacket 7 with a smooth inner surface and a still unworked outer surface. The thickness of the press jacket 7 is selected in accordance with its purpose of use. For instance, very thick press jackets 7 could be produced by pouring on two or more layers of jacket material 17.

The press jacket 7 in FIG. 2*a* has a plurality of longitudinal threads 15 extending along the axis of the jacket, distributed uniformly over the circumference of the jacket at a constant circumferential distance of preferably 1 to 3 mm radially out from the inside of the press jacket. The spacing of these threads from the inside of the press jacket 7 must be large enough to define a useful wear layer of jacket material. However, that distance must also be so slight that the necessary flexibility of the belt is retained. The longitudinal threads form an inner layer of reinforcement threads. They impart the required stability in shape to the press jacket over the longitudinal width of the press zone.

On the radial side of the longitudinal threads 15 facing away from the inside of the press jacket 7, there is a layer of circumferential threads 16. These define the second layer of reinforcement threads. The layer of circumferential threads 16 is formed by wrapping a thread or usually several threads along a helical pathway and over the longitudinal threads 15, as can be seen in FIG. 2b, and the threads 16 rest with initial tension against the longitudinal threads 15. This initial tension must, of course, not be so great that the longitudinal threads 15 could be deflected too close to the inner wall of the press jacket 7. The reinforcement inserts comprised of longitudinal and circumferential threads are in this connection embedded in a single layer of the jacket material 17 so as to achieve a continuously homogeneous covering.

In FIG. 2b, the portion shown in FIG. 2a is shown in section along the section line A—A. The section A—A extends along the top side of the circumferential threads 16. The longitudinal threads 15 extend along the width of the press belt, are aligned parallel to each other each neighboring ones are other and are spaced at a constant distance apart. The longitudinal threads 15 extend, at least approximately, parallel to the axis of the jacket. The circumferential threads 16 are also parallel to each other and neighboring ones are equidistantly spaced from each other. But, corresponding to the method of manufacture still to be described, the circumferential threads extend obliquely to the outer edge of the press jacket 7.

Figure 3:
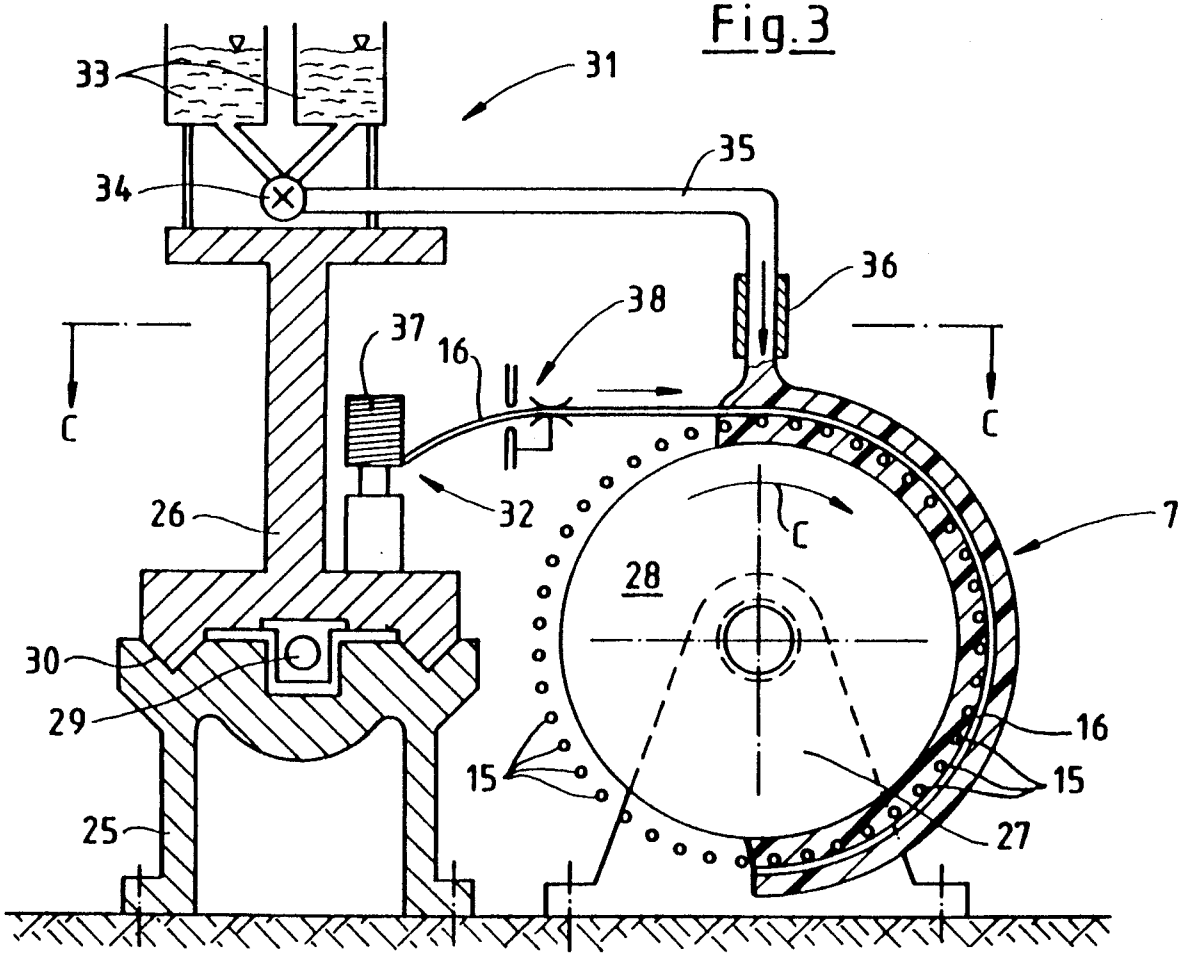
FIG. 3 schematically shows an apparatus for the manufacture of a press jacket, shown partly in front view and partly in cross section.

The press jacket 7 is formed using the apparatus shown in FIG. 3. A material supply, generally indicated at 31, includes a pair of material hoppers 33 whose outputs are fed through a valve 34 to a supply duct 35. The duct 35 delivers elastomeric material to a pouring nozzle 36.

The supply 31 and nozzle 36 are carried by a support 26 which can slide on rails 30 relative to a stationary support 25 through the action of a translating device 29 such as a screw thread or hydraulic piston.

The support 26 also carries thread rolls 37 which deliver the circumferential thread 16 through a thread guide 38 to the pouring body 28.

Before starting operation of the apparatus shown in FIG. 3, the pouring body 28 is prepared with longitudinal threads 15 tensioned or distributed above the entire surface of the body 28 at uniform distances apart from each other. The longitudinal threads 15 lie parallel to each other and thus form a coaxial cage arrangement over the circumference of the pouring body 28.

The starting end of the circumferential thread 16 is then fastened to one axial end of the pouring body 28.

The pouring body 28 is next turned in the direction of arrow C. At the same time, the pouring nozzle 36 is opened. The elastomeric jacket material 17 flows onto the surface of the pouring body 28 above which the tensioned longitudinal threads 15 are supported, and this forms a coaxial press jacket layer on the pouring body 28. During rotation of the pouring body 28, the circumferential thread 16 is wound on at the same time, preferably under a certain initial tension. This initial tension is established so that the circumferential thread 16 lies taut on the longitudinal threads 15 and may even deflect the longitudinal threads slightly toward the surface of the pouring body 28. During rotation of the pouring body 28 and the pouring of the jacket material 17, the support 26 for the nozzle 36 is also moved linearly and along the axis of the body 28. This causes the circumferential thread 16 to now be wrapped in the manner of a spiral or helix on the cage arrangement which was formed by the longitudinal threads 15, and the threads are fixed in position upon the solidifying of the jacket material 17.

In FIG. 3, one half of the initial portion of a press jacket 7 has been shown completely poured. This starting section of the press jacket 7 is closed by continuation of the pouring process and of the winding process for the circumferential thread 16, and the process is continued over the axial length of the pouring body 28 from one longitudinal end up to the opposite end of the body 28.

Figure 4:
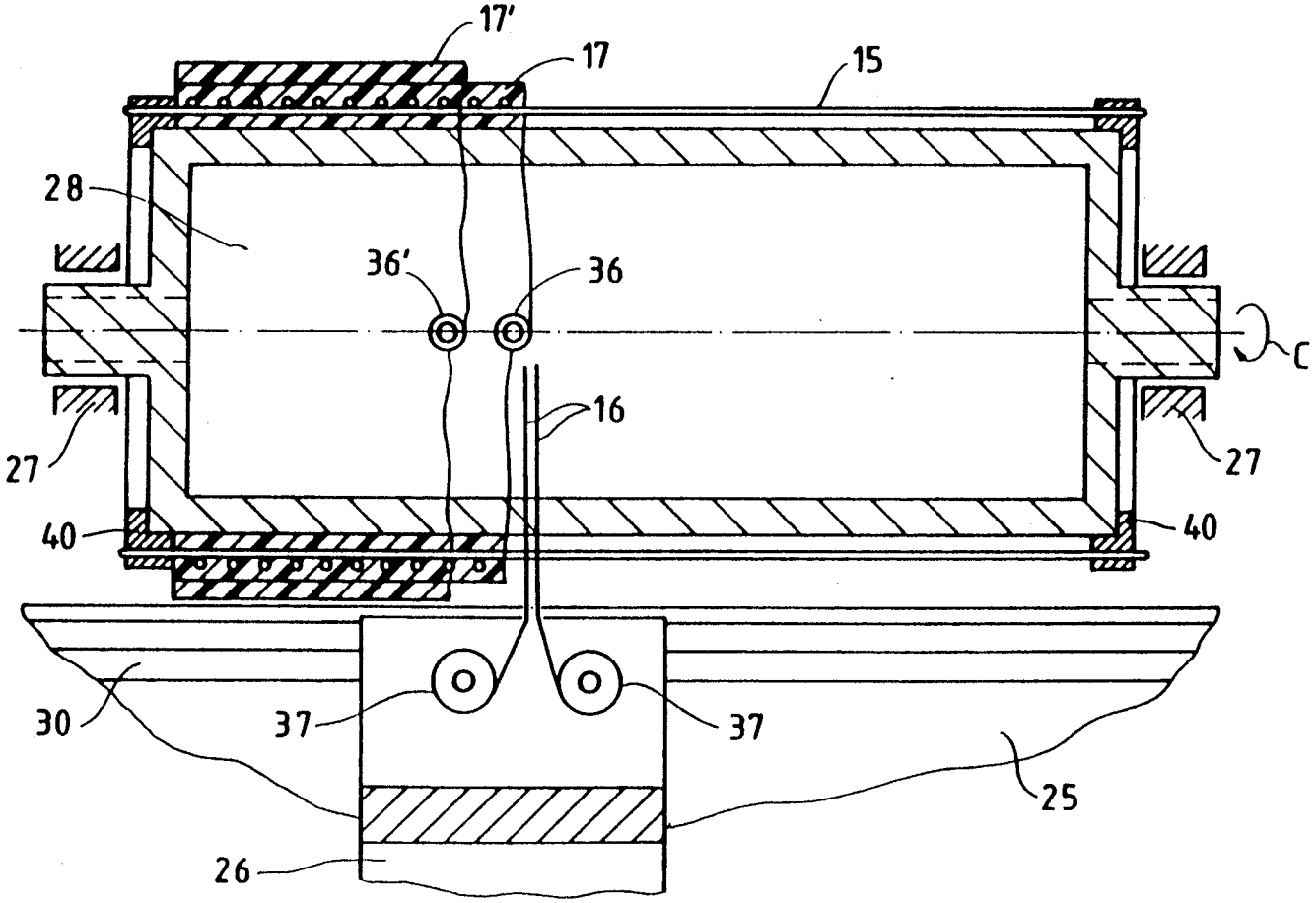
FIG. 4 schematically shows the apparatus for the manufacture of a press jacket in longitudinal section along the line C—C of FIG. 3.

FIG. 4 diagrammatically shows the apparatus of FIG. 3 in plan view, at the section line C—C of FIG. 3. The longitudinal threads 15 are tensioned above the surface of the rotating pouring body 28. That body is mounted in the bearing brackets 27. In the simplest case, shown in the drawing, that mounting is via tensioning rings 40 which rest against end surfaces of the pouring body 28. The support 26 is moved in the guide rails 30 parallel to the axis of the pouring body 28. The support carries two thread rolls 37 from which two circumferential threads 16 unwind. The support 26 is also rigidly connected to the pouring nozzle 36 so that they can move together.

With simultaneous rotary movement of the pouring body 28 and translatory, parallel to the axis movement of the support 26, a layer of elastomeric jacket material 7 is poured on the body 28 along a helical pathway. At the same time, the circumferential threads 16 are wrapped in this layer. The threads 16 are thus also pulled helically over the longitudinal threads 15.

FIG. 4 illustrates about one-third of a press jacket 7 completely poured.

FIG. 4 shows another feature of the invention. For certain applications press jackets of large thickness are required. Such thicknesses of material can, however, generally not be produced by means of a single pouring nozzle 36. To solve this problem, FIG. 4 shows a second pouring nozzle 36' which is also rigidly fastened to the support 26 and is thus moved synchronously, trailing behind the first pouring nozzle 36, along the pouring body 28. A second layer of jacket material 17' can be poured by the second pouring nozzle 36'. The reinforcement of the press jacket 7, consisting of longitudinal threads 15 and circumferential threads 16, is entirely embedded in the first layer of jacket material 17 in order to assure complete attachment between the jacket material and the reinforcement threads.

Figure 5A:
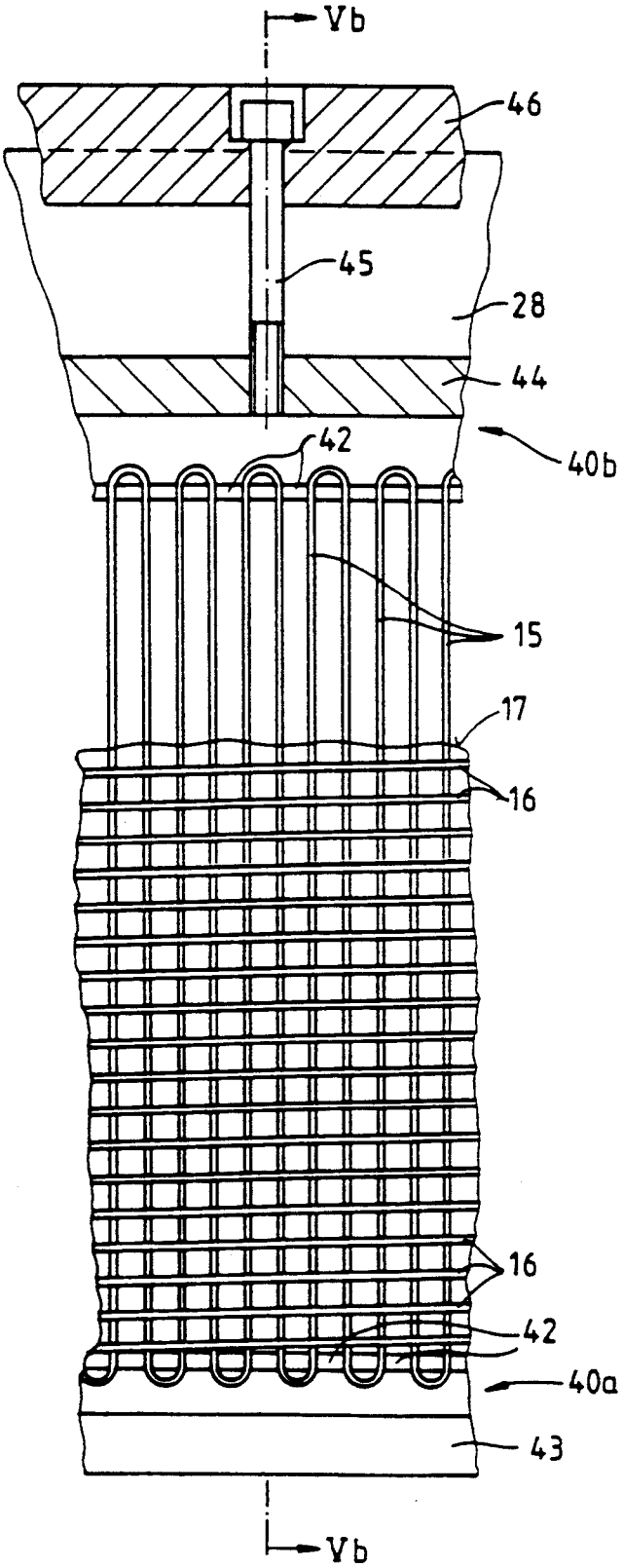
FIG. 5*a* is a top view showing a portion of the apparatus of FIGS. 3 and 4, particularly showing the inserted longitudinal threads and the circumferential threads which are poured in place.
Figure 5B:
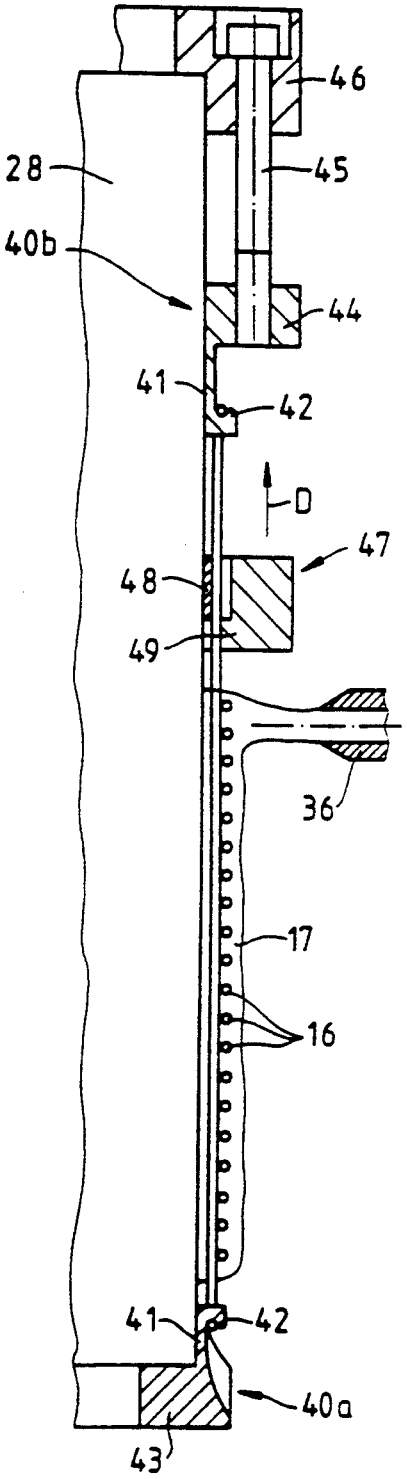
FIG. 5*b* is a longitudinal section of the same portion as in FIG. 5*a*.

FIGS. 5a and 5b show a portion of the surface of the pouring body 28 in two views. FIG. 5a shows the arrangement of the longitudinal threads 15. They are pulled back and forth along a meander path between two tensioning rings 40a, 40b along the axial length of the jacket of the pouring body 28. Each of the tensioning rings 40a, 40b comprises a cuff shaped ring 41 which has a plurality of radial projections 42 distributed over its circumference. The projections 42 determine the circumferential spacing of the longitudinal threads 15 from each other and their radial distance above the surface of the pouring body 28. The tensioning ring 40a on the lower end in FIGS. 5a and 5b has a flange attachment 43 via which the tensioning ring 40a rests against that axial end of the pouring body 28. The upper, second tensioning ring 40b is loosely seated on the pouring body 28 and is connected to a radially outwardly directed, circumferential projection 44, which, in turn, can be clamped via a fastening bolt 45 and a flange 46 which rests against the second end of the pouring body 28. Tightening the bolt supported in the stationary flange 46 moves the projection axially outward.

For inserting the longitudinal thread 15 and for suspending the thread from the projections 42 of the two rings 40*a/b*, the bolt 45 is loosened. When the longitudinal thread 15 has been suspended from the projections 42 over the entire surface of the pouring body 28 so that these thread strands thus form a closed cage between the tensioning rings 40*a/b*, the tensioning ring 40*b* which is loosely seated on the pouring body 28 is tightened toward the end of the body 28 by means of the bolt 45. This tensions the longitudinal threads 15.

With respect to the circumferential threads 16, which are pulled over the longitudinal threads 15 and also extend helically, i.e. obliquely in FIG. 5, it is also possible to turn the two tensioning rings 40*a/b* in each case so far with respect to each other that the longitudinal threads 15 also extend obliquely and then form an orthogonal grid pattern with the circumferential threads 16.

The side view of FIG. 5*b* shows the pouring nozzle 36 already advanced along the surface of the pouring body 28 beyond half the width of the press jacket 7 to be produced. Also up to this point, the circumferential thread 16 has been pulled into the jacket material 17 and over the longitudinal threads 15.

In order to reliably avoid having the longitudinal threads 15 pressed onto the surface of the pouring body 28, for instance upon pouring of the jacket material 17 or upon the tightening of the circumferential thread 16, i.e., in order to assure the spacing of the longitudinal threads 15 from the pouring body 28, a longitudinal thread guide ring 47 is moved along the body 28 synchronously with the pouring nozzle 36 and in advance of the nozzle. The longitudinal thread guide ring 47 comprises a radial spacing and holding ring 48, which lies along the axis of the pouring body between the surface of the pouring body 28 and the longitudinal threads 15. The ring 48 has a radially outwardly projecting comb like ring part 49, which includes grooves which correspond to the separation distance of the longitudinal threads 15 from each other. The longitudinal thread guide ring 47 and 48 is connected to the support 26 via a guide device. The longitudinal threads 15 are aligned over the entire circumference of the pouring body 28 by the longitudinal thread guide ring 47. The jet of jacket material 17 emerging from the pouring nozzle 36 fixes these longitudinal threads 15 in their proper position and direction. The longitudinal thread guide ring 47 carries out a linear movement with respect to the pouring body 28 and turns together with that body.

FIG. 6 again shows the pouring body 28 and the elastomeric material 17 being applied in the form of spiral bands on the outer surface of the pouring body 28. The thread guide ring 47 for the longitudinal threads is comprised of a plurality of segments 47*d* which surround the circumference of the pouring body 28. Circumferentially neighboring segments are pivotally connected to each other or are otherwise articulated to each other in the manner of a chain. The construction of the individual segments of the ring 47 or chain can be noted from FIGS. 7–8*b*.

Figure 6:
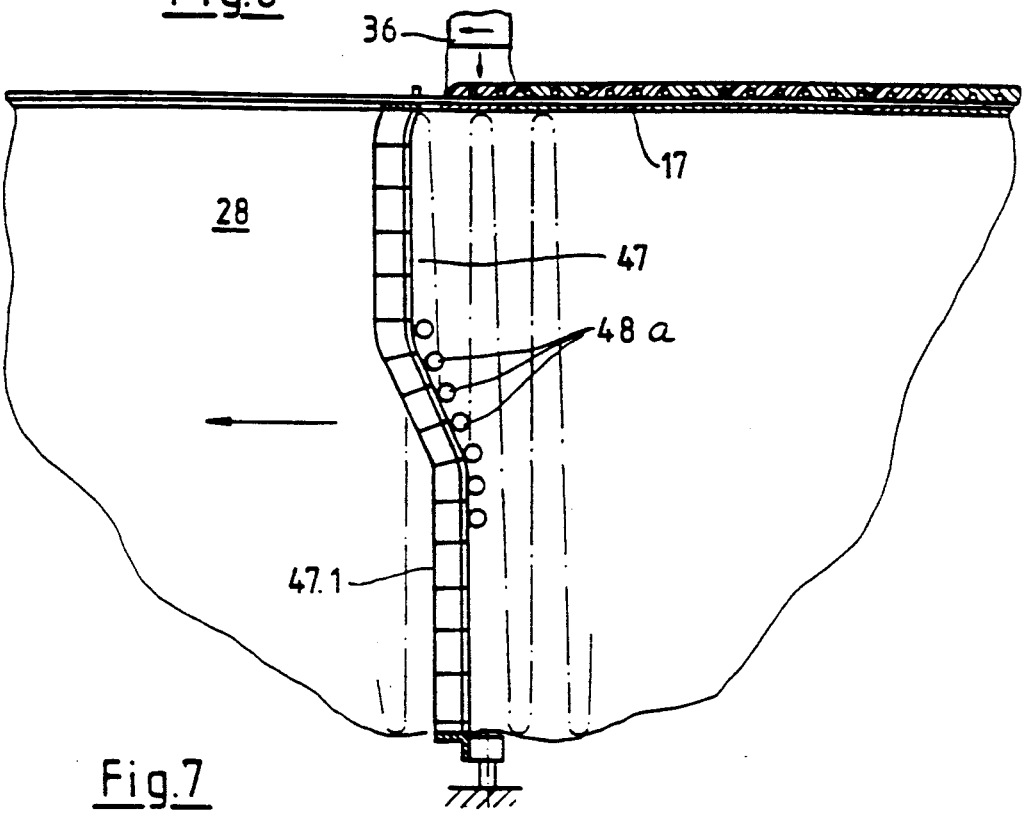
FIG. 6 is a side view of the pouring cylinder with a spacing device.

FIG. 6 also shows a slide in the form of a plurality of rollers 48*a*. They are fastened, in any manner, but not specifically shown, to the support 26, just as the pouring nozzle 36 is attached to the support.

The rollers 48*a* move axially together with the support 26 and the nozzle 36 in the direction of the longitudinal axis of the pouring body 28. The pouring body 28 with the guide ring 47 and the guided threads 15 rotate, while the support 26 and the rollers 48*a* do not rotate around the pouring body. In this connection, the rollers 48*a* on the support 26 move relatively to and therefore discontinuously engage the successive segments of the rotating segmented ring 47, each segment of the ring 47 coming into contact with successive ones of the series of rollers once upon each revolution of the pouring body 28. The rollers are each rotatably supported on and project radially from the support so that the rollers rotate around their respective axes on the support as the segments move past for reducing the drag exerted by the rollers on the guide ring 47.

Figure 7:
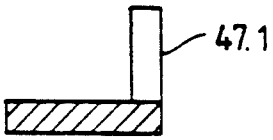
FIG. 7 shows a segment in cross section, greatly enlarged as compared with the showing in FIG. 6.

The segment 47.1 shown in FIG. 7 has an L-shaped profile. Its lower arm lies on the outer surface of the pouring body 28 while its vertical radially outward arm is contacted on its rear surface by the rollers 48*a*. The illustrated cross section of the segment 47.1 has been taken in the plane of a slot in the segment through which a longitudinal thread 15 can be passed.

Figure 8A:
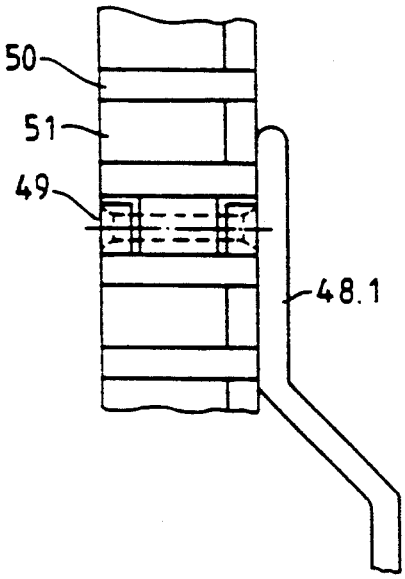
FIG. 8*a* is a top view of a spacing device developed in the form of a ring chain.
Figure 8B:
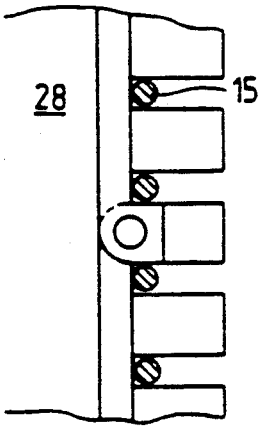
FIG. 8*b* is a view of the spacing device parallel to the axis of the pouring body in developed condition.

The ring chain shown in FIGS. 8*a* and 8*b* shows the chain connection 49 and the slots 50, with teeth 51 present between them, for receiving the longitudinal threads. Analogous to the rollers 48*a*, there is in this case provided a slide shoe 48.1 which is rigidly attached to the support 26 and which serves as an advancing element for the longitudinal thread guide device 47 or for its individual segments. The thread guide device slides past the slide shoes 48.1.

In a limiting case, the longitudinal thread guide device can consist of a single link or segment 47 which surrounds the pouring body and which has a detachable connection of its ends to form an endless loop. In this case, the guide device is shaped in this manner is comprised of an elastically bendable and flexible material, for instance, plastic. In this case the slide has elements like rollers 48*a*, which engage the single element guide device at spaced apart locations to move the guide device along the pouring body axis.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An apparatus for manufacturing an endless loop press jacket, the jacket being formed of pourable elastomeric material having reinforcement threads embedded therein, the threads including a radially inner layer of longitudinal threads which extend essentially in the axial direction of the press jacket and a radially outer layer of circumferential threads which extend in the circumferential direction around the press jacket;

the apparatus comprising:

a cylindrical rotatably mounted pouring body having a length which corresponds to the width of the press jacket to be manufactured and having an outer jacket surface with a circumference which corresponds to the length of the press jacket to be manufactured;

a tensioning device at the pouring body for tensioning the longitudinal thread sand supporting the longitudinal threads extending in the axial direction of the press jacket and at a distance from the jacket surface of the pouring body;

a feed device for feeding the circumferential threads to the pouring body surface;

first means for moving the feed device parallel to the axis of the pouring body;

a pouring nozzle for application of the elastomeric material;

second means for moving the nozzle parallel to the axis of the pouring body, the second means comprising a support for the pouring nozzle;

third means for maintaining a constant distance between the longitudinal thread and the jacket surface of the pouring body and including a spacing device for maintaining a constant distance apart between two adjacent longitudinal threads, the spacing device comprising at least one segment, said at least one segment surrounding the circumference of the pouring body, the at least one segment being elastic and having such flexibility that the spacing device may flex along its length around the pouring body;

said at least one segment having a cross section with one arm extending parallel to the longitudinal axis of the pouring body and resting against the pouring body and another radial arm extending substantially perpendicular to and projecting from the jacket surface of the pouring body, the radial arm having means for guiding the passage of the longitudinal threads and for separating the threads; and a slide rigidly connected to the support and movable along the axis of the pouring body with the support, the slide being in contact with the at least one segment at various locations along the segment, as the segment rotates with the pouring body, in order for the slide to displace the at least one segment parallel to the axis of the pouring body, corresponding to the advance of the support along that axis.

2. The apparatus of claim 1, wherein there is a single elastic segment.

3. The apparatus of claim 2, wherein the single segment is an endless loop joined at a seam.

4. The apparatus of claim 1, wherein there are a plurality of the segments neighboring around the pouring body and defining the spacing device; a respective part of the slide is in engagement with at least some of the segments as the segments and the spacing device rotate with the pouring body past the slide to displace all of the segments along the axis of the pouring body.

5. The apparatus of claim 4, wherein the segments are linked together.

6. An apparatus for manufacturing an endless loop press jacket, the jacket being formed of pourable elastomeric material having reinforcement threads embedded therein, the threads including a radially inner layer of longitudinal threads which extend essentially in the axial direction of the press jacket and a radially outer layer of circumferential threads which extend in the circumferential direction around the press jacket;

the apparatus comprising:

a cylindrical rotatably mounted pouring body having a length which corresponds to the width of the press jacket to be manufactured and having an outer jacket surface with a circumference which corresponds to the length of the press jacket to be manufactured;

a tensioning device at the pouring body for tensioning the longitudinal threads and supporting the longitudinal threads extending in the axial direction of the press jacket and at a distance from the jacket surface of the pouring body;

a feed device for feeding the circumferential threads to the pouring body surface;

first means for moving the feed device parallel to the axis of the pouring body;

a pouring nozzle for application of the elastomeric material;

second means for moving the nozzle parallel to the axis of the pouring body, the second moving means comprising a support for the pouring nozzle;

third means for maintaining a constant distance between the longitudinal threads and the jacket surface of the pouring body and including a spacing device for maintaining a constant distance apart between two adjacent longitudinal threads, the spacing device comprising a plurality of linked segments, each of the segments extending over at least a part of the circumference of the pouring body, the plurality of segments are linked by being pivotally connected to their neighboring segments, the segments having such flexibility that the spacing device may flex along its length around the pouring body;

said at least one segment having a cross section with one arm extending parallel to the longitudinal axis of the pouring body and resting against the pouring body and another radial arm extending substantially perpendicular to and projecting from the jacket surface of the pouring body, the radial arm having means for guiding the passage of the longitudinal threads and for separating the threads; and a slide rigidly connected to the support and movable along the axis of the pouring body with the support, the slide having a respective part which is in engagement with at least some of the segments as the segments rotate with the pouring body past the slide to displace all of the segments parallel to the axis of the pouring body, corresponding to the advance of the support along that axis.

7. The apparatus of claim 4, wherein the means for guiding the passage of the longitudinal threads comprises slots in the radial arm of the spacing device for enabling passage of the longitudinal threads.

8. The apparatus of claim 7, further comprising teeth on the radial arm for defining the slots between the teeth.

9. An apparatus for manufacturing an endless loop press jacket, the jacket being formed of pourable elastomeric material having reinforcement threads embedded therein, the threads including a radially inner layer of longitudinal threads which extend essentially in the axial direction of the press jacket and a radially outer layer of circumferential threads which extend in the circumferential direction around the press jacket;

the apparatus comprising:

a cylindrical rotatably mounted pouring body having a length which corresponds to the width of the press jacket to be manufactured and having an outer jacket surface with a circumference which corresponds to the length of the press jacket to be manufactured;

a tensioning device at the pouring body for tensioning the longitudinal threads and supporting the longitudinal threads extending in the axial direction of the press jacket and at a distance from the jacket surface of the pouring body;

a feed device for feeding the circumferential threads to the pouring body surface;

first means for moving the feed device parallel to the axis of the pouring body;

a pouring nozzle for application of the elastomeric material;

second means for moving the nozzle parallel to the axis of the pouring body, the second moving means comprising a support for the pouring nozzle;

third means for maintaining a constant distance between the longitudinal threads and the jacket surface of the pouring body and including a spacing device for maintaining a constant distance apart between two adjacent longitudinal threads, the spacing device comprising a plurality of segments, each of the segments extending over at least a part of the circumference of the pouring body, wherein the segments are of lengths having ends such that the ends of neighboring elements overlap, without additional connecting elements between the neighboring segments, the segments having such flexibility that the spacing device may flex along its length around the pouring body;

each of said segments having a cross section with one arm extending parallel to the longitudinal axis of the pouring body and resting against the pouring body and another radial arm extending substantially perpendicular to and projecting from the jacket surface of the pouring body, the radial arm having means for guiding the passage of the longitudinal threads and for separating the threads; and a slide rigidly connected to the support and movable along the axis of the pouring body with the support, the slide having a respective part which is in engagement with at least some of the segments as the segments rotate with the pouring body past the slide to displace all of the segments along the axis of the pouring body, corresponding to the advance of the support along that axis.

10. The apparatus of claim 4, wherein the slide comprises a plurality of separate slide elements arrayed around the support and each slide element

11. An apparatus for manufacturing an endless loop press jacket, the jacket being formed of pourable elastomeric material having reinforcement threads embedded therein, the threads including a radially inner layer of longitudinal threads which extend essentially in the axial direction of the press jacket and a radially outer layer of circumferential threads which extend in the circumferential direction around the press jacket;

the apparatus comprising:

cylindrical rotatably mounted pouring body having a length which corresponds to the width of the press jacket to be manufactured and having an outer jacket surface with a circumference which corresponds to the length of the press jacket to be manufactured;

a tensioning device at the pouring body for tensioning the longitudinal threads and supporting the longitudinal threads extending in the axial direction of the press jacket and at a distance from the jacket surface of the pouring body;

a feed device for feeding the circumferential threads to the pouring body surface;

first means for moving the feed device parallel to the axis of the pouring body;

a pouring nozzle for application of the elastomeric material;

second means for moving the nozzle parallel to the axis of the pouring body, the second moving means comprising a support for the pouring nozzle;

third means for maintaining a constant distance between the longitudinal thread and the jacket surface of the pouring body and including a spacing device for maintaining a constant distance apart between two adjacent longitudinal threads, the spacing device comprising a plurality of linked segments surrounding the circumference of the pouring body, having such flexibility that the spacing device may flex along its length around the pouring body;

each of said segments having a cross section with one arm extending parallel to the longitudinal axis of the pouring body and resting against the pouring body and another radial arm extending substantially perpendicular to and projecting from the jacket surface of the pouring body; the radial arm having means for guiding the passage of the longitudinal threads and for separating the threads; and a slide rigidly connected to the support and movable along the axis of the pouring body with the support, the slide having a respective part which is in engagement with at least some of the segments as the segments rotate with the pouring body past the slide to displace all of the segments parallel along the axis of the pouring body, corresponding to the advance of the support along that axis, the slide comprising a plurality of separate slide elements arrayed around the support, each slide element engaging a respective one of the segments as the segments rotate with the pouring body past the slide, each of said slide elements comprising a roller rotatably supported on the support for being rotated as the segments move past.

12. The apparatus of claim 1, wherein the means for guiding the passage of the longitudinal threads comprises slots in the radial arm of the spacing device for enabling passage of the longitudinal threads.

13. The apparatus of claim 12, further comprising teeth on the radial arm for defining the slots between the teeth.

* * * * *